United States Patent [19]

Gonzalez

[11] Patent Number: 4,564,894

[45] Date of Patent: Jan. 14, 1986

[54] TROUBLE LIGHT FOR VEHICLES

[76] Inventor: Jorge Gonzalez, P.O. Box 3007, Laredo, Tex. 78044

[21] Appl. No.: 680,921

[22] Filed: Dec. 12, 1984

[51] Int. Cl.[4] ..... F21V 27/00

[52] U.S. Cl. ..... 362/398; 362/376

[58] Field of Search ..... 362/376, 377, 378, 398, 362/344

[56] References Cited

U.S. PATENT DOCUMENTS

| | | | |
|---|---|---|---|
| 1,932,143 | 10/1933 | Piercy | 362/398 |
| 2,460,173 | 1/1949 | Halbing | 362/376 |
| 2,506,400 | 5/1950 | Wietz | 362/398 |
| 2,987,612 | 6/1961 | Haulter | 362/398 |
| 4,019,047 | 4/1977 | Frey | 362/378 |
| 4,369,487 | 1/1983 | Carlon | 362/398 |

FOREIGN PATENT DOCUMENTS

| | | | |
|---|---|---|---|
| 640019 | 7/1950 | United Kingdom | 362/376 |

*Primary Examiner*—Magdalen Y. C. Moy

*Attorney, Agent, or Firm*—E. F. Bard & Associates

[57] ABSTRACT

A trouble light for car mechanics, etc., which utilizes magnets to position and mount the trouble light so as to more effectively direct light on to the desired work area. In particular, it is primarily designed for use in relatively close spaces where it is either inconvenient or impossible to employ conventional means such as a hook or a second person to position and direct the light. The light includes a bracket composed of a non-ferromagnetic material such as aluminum, a plurality of magnets mounted onto the bracket, a plurality of angular ferromagnetic pole pieces for mounting the magnets onto the bracket, and a heat shield for protecting the magnets from heat radiated by the light bulb. The bracket and the heat shield are mounted to the light housing of the trouble light such that the shield is interposed between the bracket and the housing.

2 Claims, 3 Drawing Figures

FIG. 1
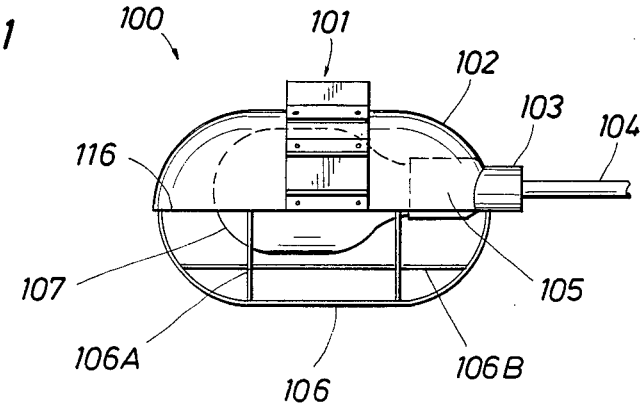
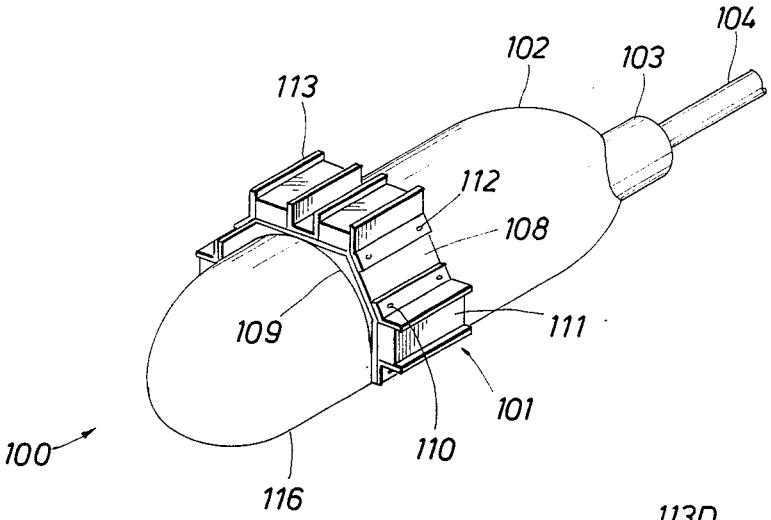
FIG. 2
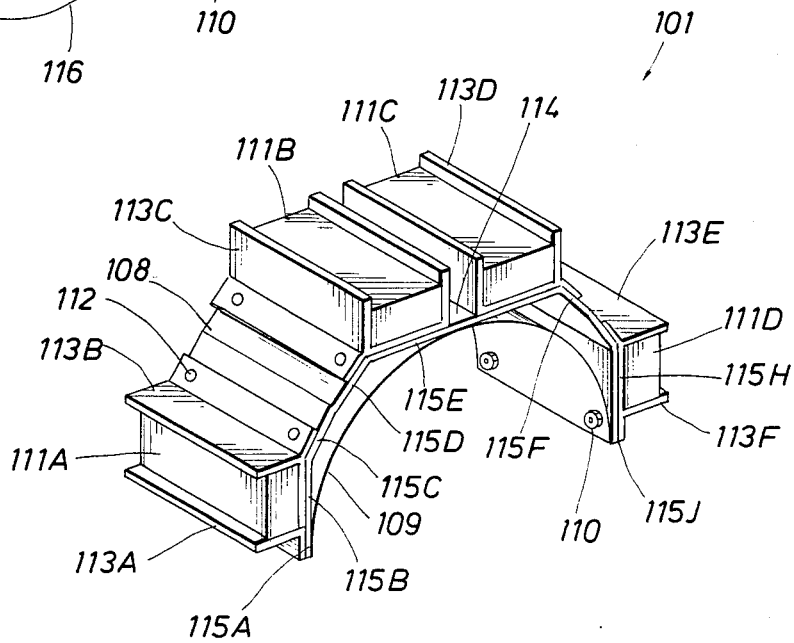
FIG. 3

TROUBLE LIGHT FOR VEHICLES

BACKGROUND OF INVENTION

This invention relates to an improved trouble light for car mechanics and more particularly relates to a trouble light which utilizes magnets to position and mount the trouble light so as to more effectively direct light onto the desired work area. It is primarily designed for use in relatively close spaces where it is either inconvenient or impossible to employ conventional means such as a hook or a second person to position and direct the light.

One of the standard tools of the automobile mechanic is a trouble light which is hung on various parts of the automobile to provide light as the mechanic goes about his tasks. Most frequently such trouble lights employ a hook at one end and such hook is draped over some part or portion of the vehicle under repair. When the hood of the car is raised, the hook is hung on some portion of the hood to cast light upon the engine. When the car is raised on a rack, the hook is hung for example on a tailpipe, cable, or some portion of the vehicle undercarriage in an effort to cast light in the direction where the work is proposed to be performed. While the hook-type of trouble light has been effective in the past and has enjoyed widespread use, it is nevertheless very difficult to position since the hook will not accomodate all portions of the vehicle that offer a location upon which the light may be hung. For example, most of the hooks are too small to encircle the drive shaft, and some of the hooks do not have sufficient openings to fit over portions of the car rack that are available as a site. In addition, once the hook-type of trouble light is employed, it is difficult if not cumbersome at best to adjust to any degree. The hook keeps the light directed in one area only and the light cannot be directed or changed readily to another work area without unhooking the light and then searching for another site from which to hang. In frustration, many mechanics just stop using the hook and merely lay the trouble light on its side close to where the mechanic is working in hopes that some light will somehow fall their way.

The present concept disclosed herein seeks to avoid the disadvantages of the hook-type of trouble light and provides a trouble light having a plural array of permanent and heat shielded magnets that may be attached to any of the various and easily accessible metal parts of the automobile. Thus, the conventional automobile has many more available metallic sites for a magnet than it has sites for hanging a hook.

In the prior art, some devices have been proposed for providing light wherein magnets are employed to hold the device for one or more reasons, and exemplary of such state of the art devices are depicted and described in the following U.S. Pat. Nos., namely: No. 2,772,349; No. 2,886,664; No. 3,539,800; No. 3,713,614; No. 3,924,117; No. 4,220,304; and No. 4,282,562. Such devices, however, are not related to the trouble light type of auto device disclosed herein but are related rather to the portable flashlight type of article and hence do not specifically refer to a light source that may be positioned on an automobile and adjusted to move a reflected beam onto various portions of the auto undergoing repair by a mechanic. There is depicted and also described in U.S. Pat. No. 1,295,333 and No. 2,460,173, trouble lights of sorts but such devices do not employ a plural array of permanent magnets let alone a heat shield for the magnets as is proposed herein. The first mentioned device resorts to electromagnets whereas the second mentioned device includes only a single permanent magnet.

These disadvantages of the prior art and especially of the aforementioned patents are overcome with the present invention and commercially acceptable embodiments of an automobile vehicle trouble light and the like are herein provided which not only provide sufficient light under most operating conditions but which are also capable of other tasks completely beyond the capabilities of the prior art. More particularly, however, the embodiments of the present invention are capable of operation with a much higher efficiency due to their heat shielded magnetic array arrangement, and at a substantially reduced cost of construction and operation. Further, they enable the user to move a trouble light about on a motor vehicle with much more ease than heretofore has been possible and because of the array of magnets provide for easy adjsutment and tilt of a reflected light beam over various portions of the automobile.

SUMMARY OF INVENTION

This invention is for a trouble light for use by automobile mechanics when making repairs which trouble light has a bracket composed of a non-ferromagnetic material such as aluminum, a plurality of magnets mounted onto the bracket, a plurality of angular ferromagnetic pole pieces for mounting the magnets onto the bracket, and a heat shield for protecting the magnets from heat radiated by the light bulb. The bracket and the heat shield are mounted to the light housing of the trouble light such that the shield is interposed between the bracket and the housing. A feature of the apparatus involves the extension of the pole pieces above the surface of the mounted magnets. In this particular embodiment, the extention is approximately equal to the height of the magnet and is also approximately equal to onehalf the width of the magnet. The extensions cause a reformation and intensification of the magnetic field in the area above the magnet and between the extensions. Thus, in such a configuration, the magnet has the apparent strength of a larger magnet.

This invention is also for a trouble light for car mechanics for use in relatively close spaces to direct light onto the desired work area having a reflector with a light bulb therein and for deflecting light generated by the light bulb onto the work area, said reflector having an upper surface, an inner surface and a lower edge, an insulated plug extending from the reflector and being connected to an extension cord for supplying electrical power to the light bulb, a socket joined to the insulated plug and with the light bulb being screw threadedly received in the socket, the lower edge of the reflector being open and having extending downwardly therefrom a reinforced wire guard for preventing the light bulb from shattering during use, a magnetic array in surrounding relationship to the upper surface of the reflector and being connected thereto and providing exterior surface areas for adjustably and removably attaching the trouble light to metal portions of the car, said array including a bracket member having an upper surface, an inner surface, and a pair of lower edges, said bracket member being of non-ferromagnetic material and following substantially the contour of the reflector, said bracket member including a plurality of integral, flat, angular sections bent one with respect to the other and providing a corresponding plurality of flat upper surface sections on the bracket member, a heat shield strip of galvanized tin interposed between the upper surface of the reflector and the inner surface of the bracket member and being of substantially the contour of the reflector and bracket member, the ends of the heat shield strip and the lower edges of the bracket member being attached to the lower edge of the reflector, a plurality of permanent bar magnets of magnetized soft iron spaced about the upper surface of the bracket member along the flat sections thereof, and a corresponding plurality of ferromagnetic pairs of pole pieces for securing the magnets to the bracket member, each pair of pole pieces being associated with at least one of said magnets and being spaced, connected and arranged about the upper surface of the bracket member along the flat sections thereof, each pole piece of each pair extending above the surface of the magnet associated therewith a distance approximately equal to the height of the magnet and also approximately equal to about one-half the width of the magnet thereby causing a reformation and intensification of the magnetic field in the area above the magnet and between the extensions of each of the pole piece pairs in order to increase the apparent strength of the magnets.

Accordingly, it is a feature, object and advantage of the herein described and depicted present invention, to provide an improved trouble light for car mechanics which utilizes magnets to position and mount the trouble light so as to more effectively direct light onto the desired work area.

It is another feature, object and advantage of the herein described and depicted present invention, to provide a trouble light that is primarily designed for use in relatively close spaces where it is either inconvenient or impossible to employ conventional means such as a hook or a second person to position and direct the light.

It is a further feature, object and advantage of the herein described and depicted present invention to provide a trouble light which utilizes magnets to position and mount the trouble light, and a heat shield for protecting the magnets from heat radiated by the light.

It is yet another feature, object and advantage of the herein described and depicted present invention to provide a trouble light which utilizes magnets to position and mount the trouble light and wherein extended pole pieces are employed to cause a reformation and intensification of the magnetic field in the area above the magnet and between the pole piece extensions.

These and other features, objects and advantages of the present invention will become apparent from the following detailed description, wherein reference is made to the figures in the accompanying drawings.

IN THE DRAWINGS

FIG. 1 is a pictorial representation of a trouble light for use by a vehicle mechanic embodying the concepts of the present invention.

FIG. 2 is an isometric pictorial representation of a simplified trouble light for use by a vehicle mechanic and embodying the concepts of the present invention.

FIG. 3 is an isometric pictorial representation of a portion of the device of FIGS. 1 and 2 set forth in more or less exploded fashion to illustrate in an enlarged scale the details of the mechanical features and configurations of the magnetic array and heat shield of the trouble light embodying the concepts of the present invention.

DETAILED DESCRIPTION

In the drawings and in particular in FIG. 1, there will be seen a trouble light 100 for use by an automobile mechanic during repair of a vehicle, and including a magnetic array 101 for positioning and holding the trouble light 100 on various metal portions of the vehicle such as the hood, engine, and undercarriage.

Trouble light 100 includes a light reflector housing 102 which has an insulated plug 103 and a socket 105 for receiving a light bulb 107. Housing 102 covers one half of light 107 and is open at the bottom edge 116 in order to reflect and direct the light from bulb 107 onto the area desired to be illuminated. Reflector 102 includes a lamp guard 106 extending therebelow and covering light bulb 107 in order to prevent the bulb 107 from being shattered during use. The guard 106 is made of stiff wire so as not to interfere with the beam cast by bulb 107, and may include two or more vertical wire support portions 106A as well as horizontal reinforcing wires 106B. Wires 104 of an electric extension cord supply the power to operate the trouble light 100.

In FIG. 2, the reflector 102 of trouble light 100 is seen in more detail and with the inclusion of the magnetic array 101, which array 101 has a plurality of permanent magnets 111 preferably each a bar of magnetized soft iron. Magnets 111 are held in place by a plurality of pole pieces 113 each made of ferromagnetic material and having rivets 112 for connecting them to bracket 108. The bracket 108 is attached to reflector 102 by means of a nut and bolt pair 110, and interposed between reflector 102 and bracket 108 is heat shield 109 preferably made of a sheet of galvanized tin. The material of construction of the bracket 108 is typically a non-ferromagnetic material such as aluminum. It is the function of the heat shield 109 to protect the magnets 111 from the heat generated and radiated by the light bulb 107.

The details of the heat shielded magnetic array 101 can be seen in FIG. 3 and will be seen to include bracket 108 which forms the support member of the array 101 and which bracket 108 carries heat shield 109 on its underside and with the pole pieces 113 and magnets 111 on its upperside. One of the pair of nut and bolt 110 for connecting the assembly 101 to the reflector 102 is shown at the lower right hand edge of the bracket 108, and it should be noted that another suitable fastener is included for the lower left hand edge of bracket 108.

As noted hereinbefore, the bracket 108 is of a non-ferromagnetic material such as aluminum and includes a series of sections 115A–H and 115J integral with one another but angularly bent with respect to one another to form a 180 degree arc as well as to provide a series of flat surfaces for the mounting of magnets 111 and pole pieces 113. Heat shield 109 is attached to end bracket sections 115A and 115J.

With further regard to FIG. 3, the flat surfaces on the top of bracket 108 provided by sections 115A–115H and 115J are utilized for mounting four permanent bar magnets 111A–111D each of magnetized soft iron. While four magnets are preferred, other numbers and arrangements of the magnets and pole pieces may be provided. For example, at least two more magnets could be added to FIG. 3, and pair 111B and 111C or pair 111A and 111D, could be eliminated, if desired. Each magnet 111A–D is mounted to and held in place on bracket 108 by means of a series of angular ferromagnetic pole pieces 113A–F and one channel-shaped ferromagnetic pole piece 114. Rivets 112 are used to affix each of the pole pieces 113A–F and 114 to the bracket 108, and its various angular flat surface sections 115A–H and J. As seen in FIG. 3, the light can be attached to a metal surface using any one of each of the following pairs of pole pieces, namely pole piece pair 113A–B, pole piece pair 113C, 114, pole piece pair 114, 113D, and pole piece pair 113E–F.

It is preferred that the various pole pieces 113A–F and 114 extend above the surface of the magnets 111A–D, and that the extension be approximately equal to the height of the magnet and also approximately equal to one half the width of the magnets 111A–D. Such extensions cause a reformation and intensification of the magnetic field in the area above each of the magnets and between the pole piece extensions such that each magnet has the apparent strength of a larger magnet.

It will be apparent from the foregoing that many other variations and modifications may be made in the structures and methods described herein without departing substantially from the essential concept of the present invention. Accordingly, it should be clearly understood that the forms of the invention described herein and depicted in the accompanying drawings are exemplary only and are not intended as limitations in the scope of the present invention.

What is claimed is:

1. A bracket member for attaching to a light reflector comprising a member having an upper surface, an inner surface, and a pair of lower edges, said bracket member being of non-ferromagnetic material and following substantially the contour of the reflector, said bracket member including a plurality of integral, flat, angular sections bent one with respect to the other and providing a corresponding plurality of flat upper surface sections on the bracket member, a heat shield strip of galvanized tin adapted to be interposed between the upper surface of the reflector and the inner surface of the bracket member and being of substantially the contour of the bracket member, the ends of the heat shield strip and the lower edges of the bracket member being adapted to be attached to the reflector, a plurality of permanent bar magnets of magnetized soft iron spaced about the upper surface of the bracket member along the flat sections thereof, and a corresponding plurality of ferromagnetic pairs of pole pieces for securing the magnets to the bracket member, each pair of pole pieces being associated with at least one of said magnets and being spaced, connected, and arranged about the upper surface of the bracket member along the flat sections thereof, each pole piece of each pair extending above the surface of the magnet associated therewith a distance approximately equal to the height of the magnet and also approximately equal to about one-half the width of the magnet thereby causing a reformation and intensification of the magnetic field in the area above the magnet and between the extensions of each of the pole piece pairs in order to increase the apparent strength of the magnets.

2. A trouble light for car mechanics for use in relatively close spaces to direct light onto the desired work area comprising a reflector having a light bulb therein and for deflecting light generated by the light bulb onto the work area, said reflector having an upper surface, an inner surface, and a lower edge, an insulated plug extending from the reflector and being connected to an extension cord for supplying electrical power to the light bulb, a socket joined to the insulated plug and with the light bulb being screw threadedly received in the socket, the lower edge of the reflector being open and having extending downwardly therefrom a reinforced wire guard for preventing the light bulb from shattering during use, a magnetic array in surrounding relationship to the upper surface of the reflector and being connected thereto and providing exterior surface areas for adjustably and removably attaching the trouble light to metal portions of the car, said array including a bracket member having an upper surface, an inner surface, and a pair of lower edges, said bracket member being of non-ferromagnetic material and following substantially the contour of the reflector, said bracket member including a plurality of integral, flat, angular sections bent one with respect to the other and providing a corresponding plurality of flat upper surface sections on the bracket member, a heat shield strip of galvanized tin interposed between the upper surface of the reflector and the inner surface of the bracket member and being of substantially the contour of the reflector and bracket member, the ends of the heat shield strip and the lower edges of the bracket member being attached to the lower edge of the reflector, a plurality of permanent bar magnets of magnetized soft iron spaced about the upper surface of the bracket member along the flat sections thereof, and a corresponding plurality of ferromagnetic pairs of pole pieces for securing the magnets to the bracket member, each pair of pole pieces being associated with at least one of said magnets and being spaced, connected, and arranged about the upper surface of the bracket member along the flat sections thereof, each pole piece of each pair extending above the surface of the magnet associated therewith a distance approximately equal to the height of the magnet and also approximately equal to about one-half the width of the magnet thereby causing a reformation and intensification of the magnetic field in the area above the magnet and between the extensions of each of the pole piece pairs in order to increase the apparent strength of the magnets.

* * * * *